US008690396B2

(12) United States Patent
Yatsuda et al.

(10) Patent No.: US 8,690,396 B2
(45) Date of Patent: Apr. 8, 2014

(54) PROJECTION LENS FOR LIGHTING EQUIPMENT AND LIGHTING EQUIPMENT USING PROJECTION LENS FOR LIGHTING EQUIPMENT

(75) Inventors: Yasushi Yatsuda, Tokyo (JP); Ryotaro Owada, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 664 days.

(21) Appl. No.: 12/672,116

(22) PCT Filed: Jul. 28, 2008

(86) PCT No.: PCT/JP2008/063505

§ 371 (c)(1),
(2), (4) Date: May 20, 2010

(87) PCT Pub. No.: WO2009/020000

PCT Pub. Date: Feb. 12, 2009

(65) Prior Publication Data

US 2011/0063874 A1 Mar. 17, 2011

(30) Foreign Application Priority Data

Aug. 8, 2007 (JP) ..... 2007-206847

(51) Int. Cl.
*F21V 3/00* (2006.01)

(52) U.S. Cl.
USPC ..... 362/311.08; 362/268

(58) Field of Classification Search
USPC ..... 362/169, 215, 216, 268, 296.06, 311.08
See application file for complete search history.

(56) References Cited

U.S. PATENT DOCUMENTS

| | | | | |
|---|---|---|---|---|
| 2003/0107901 | A1 | 6/2003 | Tokoro et al. | |
| 2004/0251469 | A1 * | 12/2004 | Yatsuda et al. | 257/100 |
| 2006/0083002 | A1 * | 4/2006 | Koike et al. | 362/326 |
| 2009/0040769 | A1 * | 2/2009 | Parkyn et al. | 362/310 |

FOREIGN PATENT DOCUMENTS

| | | | |
|---|---|---|---|
| JP | 03-122902 | A | 5/1991 |
| JP | 08-17045 | B2 | 2/1996 |
| JP | 2003-123519 | A | 4/2003 |
| JP | 2005-183090 | A | 7/2005 |
| JP | 2006-156301 | A | 6/2006 |
| JP | 2007-109561 | A | 4/2007 |

OTHER PUBLICATIONS

International Search Report for PCT/JP2008/063505 dated Oct. 21, 2008.

* cited by examiner

*Primary Examiner* — Andrew Coughlin
(74) *Attorney, Agent, or Firm* — Kenealy Vaidya LLP

(57) ABSTRACT

A projection lens for lighting equipment of an aspect of the present invention is characterized by formed in a shape where N of sector-shaped lens parts each of which corresponds to a central angle 2α degrees (α=180/N, N is an integer more than or equal to 3) and is bilaterally symmetric in a rotationally asymmetric elliptical collimator lens are circumferentially disposed. The projection lens for lighting equipment of such aspect is formed in the shape where N of the sector-shaped lens parts each of which corresponds to a central angle 2α degrees (α=180/N, N is an integer more than or equal to 3) and is bilaterally symmetric in the rotationally asymmetric elliptical collimator lens are circumferentially disposed. Accordingly, the projection lens for lighting equipment with a novel design which has a shape of a N-sided polygon (e.g. quadrilateral) in planar view or a shape similar to the N-sided polygon and has common edges (N edges) formed on a surface without impairment in function as a collimator lens can be configured.

3 Claims, 9 Drawing Sheets

PROJECTION LENS FOR LIGHTING EQUIPMENT AND LIGHTING EQUIPMENT USING PROJECTION LENS FOR LIGHTING EQUIPMENT

This application is a U.S. national phase filing under 35 U.S.C. §371 of PCT Application No. PCT/JP2008/063505, filed Jul. 28, 2008, and claims priority thereto under 35 U.S.C. §119 to Japanese patent application no. 2007-206847, filed Aug. 8, 2007, the entireties of both of which are incorporated by reference herein.

TECHNICAL FIELD

The disclosed subject matter relates to a projection lens for lighting equipment, and particularly, to a projection lens for lighting equipment that is applied to a projection lens and the like of a projector type headlamp mounted on a vehicle such as an automobile.

BACKGROUND ART

Conventionally, a projector type headlamp to be mounted on a vehicle such as an automobile has been known (e.g., see Patent Document 1). The projector type headlamp described in Patent Document 1 comprises a projection lens 300 (collimator lens) including a rotationally symmetric incident surface 310 that light from a light source (not illustrated) enters, and a rotationally symmetric spherical surface 320 irradiated with the incident light, as illustrated in FIG. 7.

As for the projector type headlamp of this kind, a projection lens with a novel design has recently been desired in terms of improving flexibility in vehicle design and the like. As the projection lens with the novel design, it can be considered that a projection lens which has a shape of an N-sided polygon (e.g., quadrilateral) in planar view or a shape similar to the N-sided polygon and has common edges (N edges) formed on the surface is configured.

Patent Document 1: Japanese Examined Application Publication No. 8-17045

DISCLOSURE

However, even if the projection lens described in Patent Document 1 is improved, it may be difficult to configure the projection lens that has a shape of an N-sided polygon (e.g. quadrilateral) in planar view or a shape similar to the N-sided polygon and has common edges (N edges) formed on the surface without impairment in function as a projection lens.

The disclosed subject matter is made in view of such situations, and has an aspect to provide a projection lens for lighting equipment with a novel design which has a shape of an N-sided polygon (e.g., quadrilateral) in planar view or a shape similar to the N-sided polygon and has common edges (N edges) formed on the surface without impairment in function as a collimator lens (e.g., projection lens).

MEANS FOR SOLVING THE PROBLEMS

The disclosed subject matter is made to solve the above-mentioned problem, and a projection lens for lighting equipment according to a first aspect of the disclosed subject matter is characterized by formed in a shape where N of sector-shaped lens parts each of which corresponds to a central angle $2\alpha$ degrees ($\alpha$=180/N, N is an integer more than or equal to three) and is bilaterally symmetric in a rotationally asymmetric elliptical collimator lens are circumferentially disposed.

The projection lens for lighting equipment according to the first aspect of the disclosed subject matter is formed in the shape where N of sector-shaped lens parts each of which corresponds to the central angle $2\alpha$ degrees ($\alpha$=180/N, N is an integer more than or equal to three) and is bilaterally symmetric in the rotationally asymmetric elliptical collimator lens are circumferentially disposed. According to the projection lens for lighting equipment according to the first aspect of the present invention, the projection lens for lighting equipment with the novel design which has a shape of a N-sided polygon (e.g., quadrilateral) in planar view or a shape similar to the N-sided polygon and has common edges (N edges) formed on the surface can thus be configured without impairment in function as a collimator lens.

A projection lens for lighting equipment according to a second aspect of the disclosed subject matter is characterized in that, in the projection lens for lighting equipment according to the first aspect, the shape of the rear surface of the elliptic collimator lens is formed such that a sectional shape which is to appear by section along a plane including the optical axis and the minor axis thereof and a plane parallel to the plane becomes a concave curve and a sectional shape which is to appear by section along a plane including the optical axis and the major axis thereof and a plane parallel to the plane becomes a convex curve.

According to the projection lens for lighting equipment of the second aspect, the shape of the rear surface of the elliptic collimator lens is formed such that the sectional shape which is to appear by section along a plane including the optical axis and the minor axis thereof and a plane parallel to the plane becomes a concave curve and a sectional shape which is to appear by section along a plane including the optical axis and the major axis thereof and a plane parallel to the plane becomes a convex curve. That is, since the shape of the rear surface of the collimator lens is formed in a rotationally asymmetric saddle-shaped surface convex along the minor axis, the capturing angle of light radiated by the light source increases in comparison with a case where the rear surface is formed as a plane or the like. In effect, the efficiency is improved in utilization of light radiated by the light source.

A projection lens for lighting equipment according to a third aspect of the disclosed subject matter is characterized in that, in the projection lens for lighting equipment according to the second aspect, the bilaterally symmetric sector-shaped lens part is a sector-shaped lens part bilaterally symmetric with respect to the minor axis of the collimator lens.

According to the projection lens for lighting equipment of the third aspect, since the bilaterally symmetric sector-shaped lens part is the sector-shaped lens part bilaterally symmetric with respect to the minor axis of the collimator lens, increase in oblateness of the collimator lens thus allows a configuration of the collimator lens which is more similar to the N-sided polygon in planar view. Since the sector-shaped lens part includes the saddle shaped surface convex along the minor axis as the shape of the rear surface of the collimator lens, the capturing angle of light radiated by the light source increases in comparison with a case where the rear surface is formed as a plane or the like. In effect, the efficiency is improved in utilization of light radiated by the light source.

A projection lens for lighting equipment according to a fourth aspect of the disclosed subject matter is characterized in that, in the projection lens for lighting equipment according to the second or third aspect, the concave curve and the convex curve are a quadric curve, a hyperbola or a spline curve.

This is an example of the concave curve and the convex curve. Therefore, another curve can be adopted as the concave curve and the convex curve.

Lighting equipment according to a fifth aspect of the disclosed subject matter is characterized by using the projection lens for lighting equipment according to any one of the first to fourth aspects.

According to the projection lens for lighting equipment of the fifth aspect, the lighting equipment (e.g., vehicular headlamp) using the projection lens for lighting equipment with the novel design which has the shape of the N-sided polygon (e.g., quadrilateral) in planar view or the shape similar to the N-sided polygon and has the common edges (N edges) formed on the surface can be configured.

The disclosed subject matter can provide a projection lens for lighting equipment with a novel design which has a shape of an N-sided polygon (e.g., quadrilateral) in planar view or a shape similar to the N-sided polygon and has common edges (N edges) formed on the surface without impairment in function as a collimator lens.

DESCRIPTION OF SYMBOLS

10 . . . sector-shaped lens part
20 . . . edge
30 . . . flange
100 . . . projection lens for lighting equipment
200 . . . elliptical collimator lens
F1 and F2 . . . foci
M1 . . . shape of rear surface
M2 . . . shape of front surface
X . . . optical axis

DESCRIPTION OF EXEMPLARY EMBODIMENTS

An embodiment of a projection lens for lighting equipment according to the disclosed subject matter will hereinafter be described with reference to the drawings.

Figure 1:
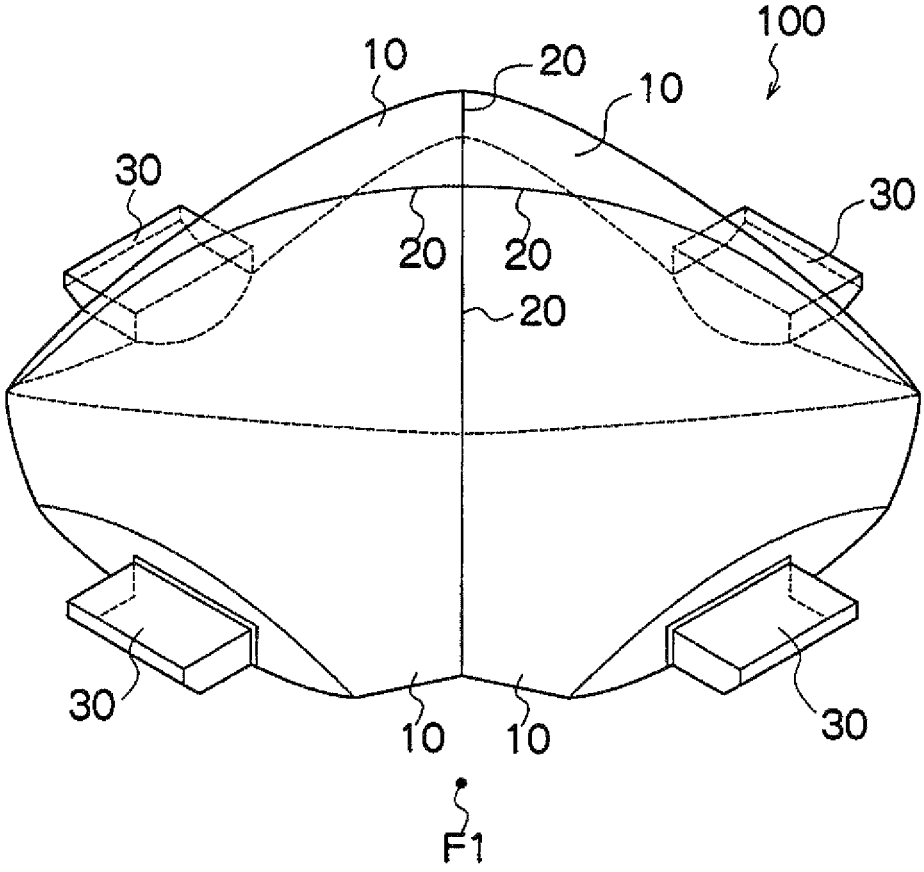
FIG. 1 is a perspective view of an embodiment of a projection lens for lighting equipment made in accordance with principles of the disclosed subject matter.
Figure 2:
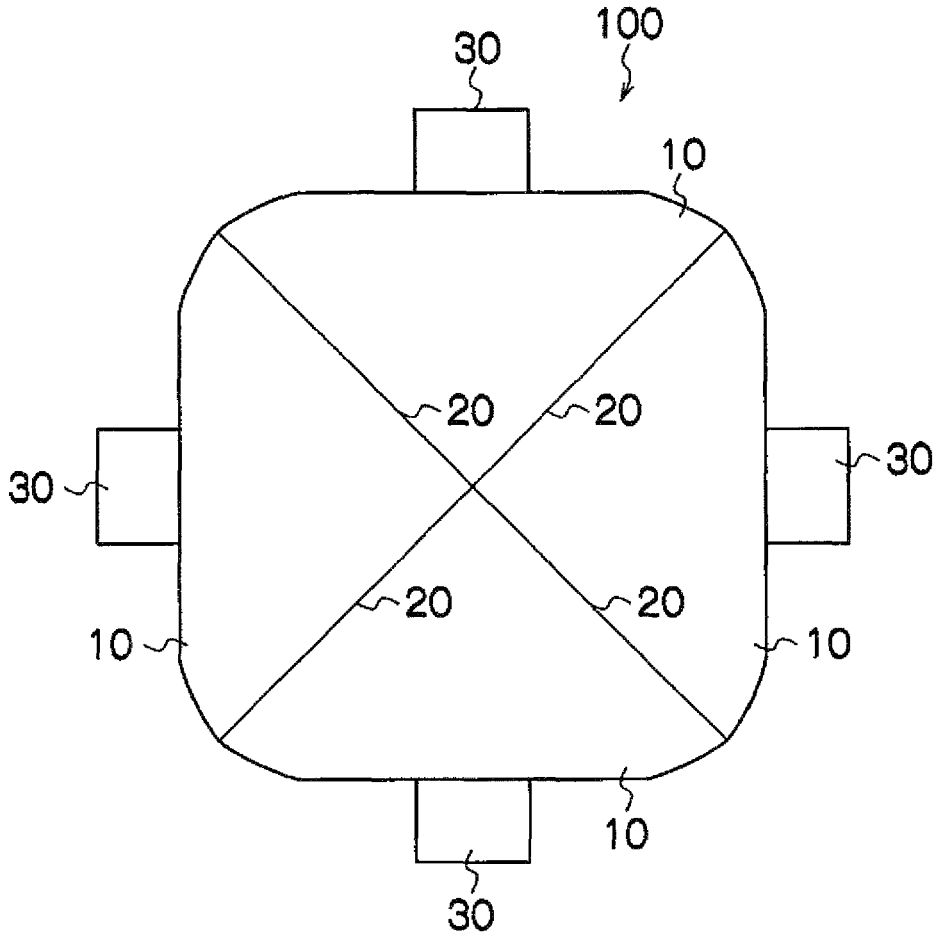
FIG. 2 is a plan view of the projection lens for lighting equipment illustrated in FIG. 1.
Figure 3:
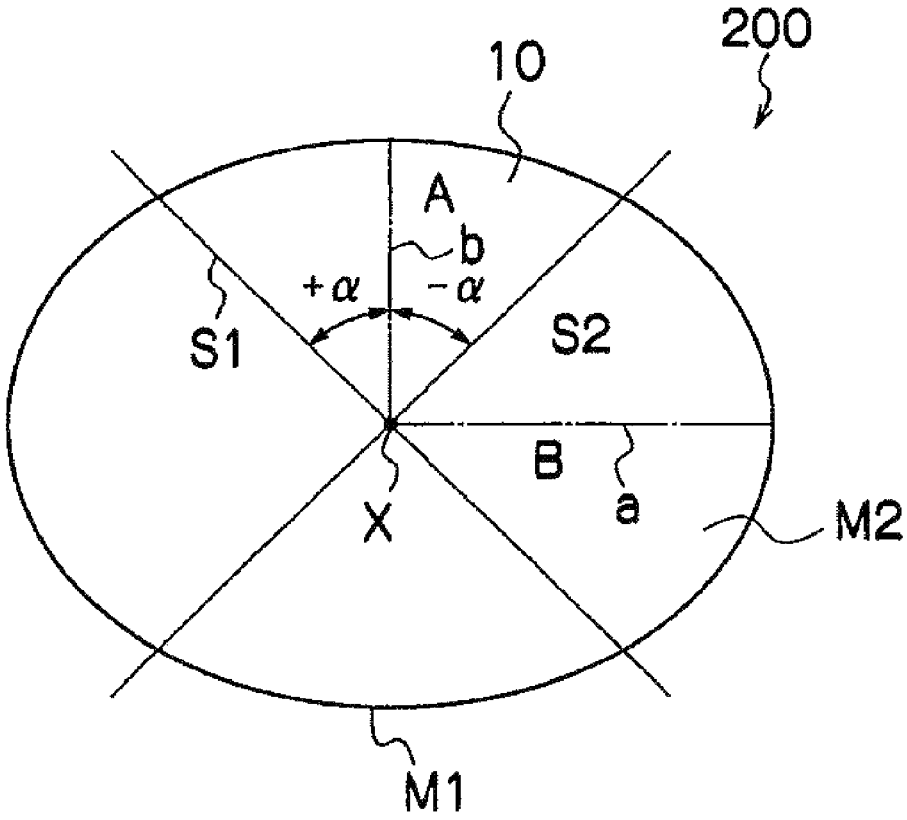
FIG. 3 is a diagram illustrating an elliptical collimator lens.

FIG. 1 is a perspective view of an embodiment of a projection lens for lighting equipment made in accordance with principles of the disclosed subject matter. FIG. 2 is a plan view of the projection lens for lighting equipment illustrated in FIG. 1. FIG. 3 is a diagram illustrating an elliptical collimator lens 200.

The projection lens 100 for lighting equipment illustrated in FIGS. 1 and 2 is a collimator lens which has one focus F1 on a side of a light source (not illustrated) and has a function of adjusting light radiated by the light source to be parallel. The lens can, for instance, be applied to a projection lens of a projector type headlamp (not illustrated) to be mounted on a vehicle such as an automobile.

The projection lens 100 can be formed in a corresponding shape where a sector-shaped lens part 10 is conceptually cut out from the rotationally asymmetric elliptical collimator lens 200 (hereinafter referred to as elliptical collimator lens 200) virtually defined as illustrated in FIG. 3 and in turn four of the conceptually cut out sector-shaped lens parts 10 are circumferentially disposed as illustrated in FIGS. 1 and 2. The projection lens 100 can be integrally formed, for instance, by injection-molding a transparent or translucent material such as acryl, polycarbonate or the like. A flange portion 30 can be provided on each side of the projection lens 100.

Figure 4:
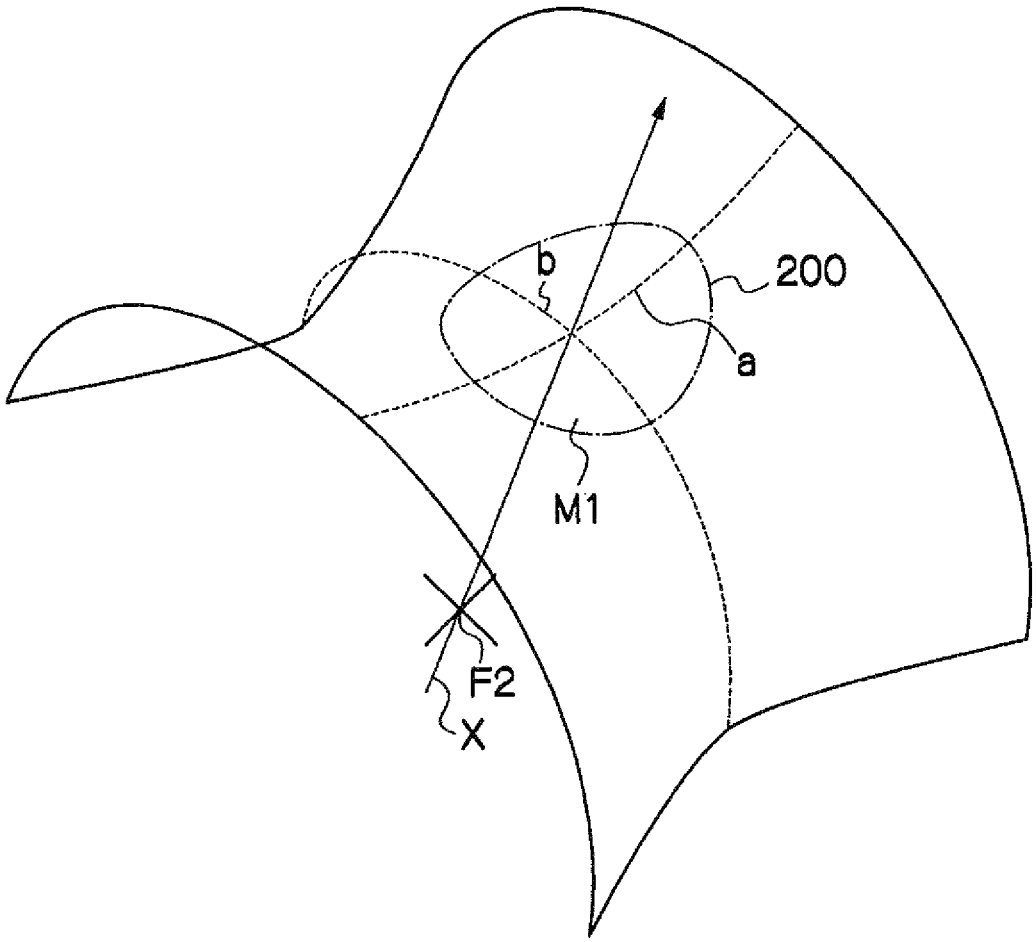
FIG. 4 is a diagram illustrating a shape of the rear surface of the elliptical collimator lens.

FIG. 4 is a diagram illustrating the shape of the rear surface of the elliptical collimator lens 200.

The elliptical collimator lens 200 can be a rotationally asymmetric and elliptical lens having one focus F2 on a side of the light source (not illustrated) and can be configured to function to adjust light radiated by the light source to become parallel.

The shape of the rear surface M1 (a surface on the light source side) of the elliptical collimator lens 200 can be formed such that a sectional shape of the rear surface M1 which is to appear by section along a plane including an optical axis X and a minor axis b (likewise, a plane parallel to this plane) can be a free curve (concave curve concaved away from the light source) such as a quadric curve, hyperbola or spline curve. For instance, the shape of the rear surface M1 can be formed such that the sectional shape of the rear surface M1 which is to appear by section along a plane including the optical axis X and the minor axis b (likewise, a plane parallel to this plane) can be a concave curve b1 as illustrated in FIG. 5.

Furthermore, the shape of the rear surface M1 of the elliptical collimator lens 200 can be formed such that a sectional shape of the rear surface M1 which is to appear by section along a plane including the optical axis X and the major axis a (likewise, a plane parallel to this plane) can be a free curve (convex curve that is convex toward the light source) such as a quadric curve, hyperbola or spline curve. That is, the shape of the rear surface M1 of the elliptical collimator lens 200 can be formed as a rotationally asymmetric saddle-shaped surface (concave surface) having an appearance that is convex along the minor axis b.

Figure 5:
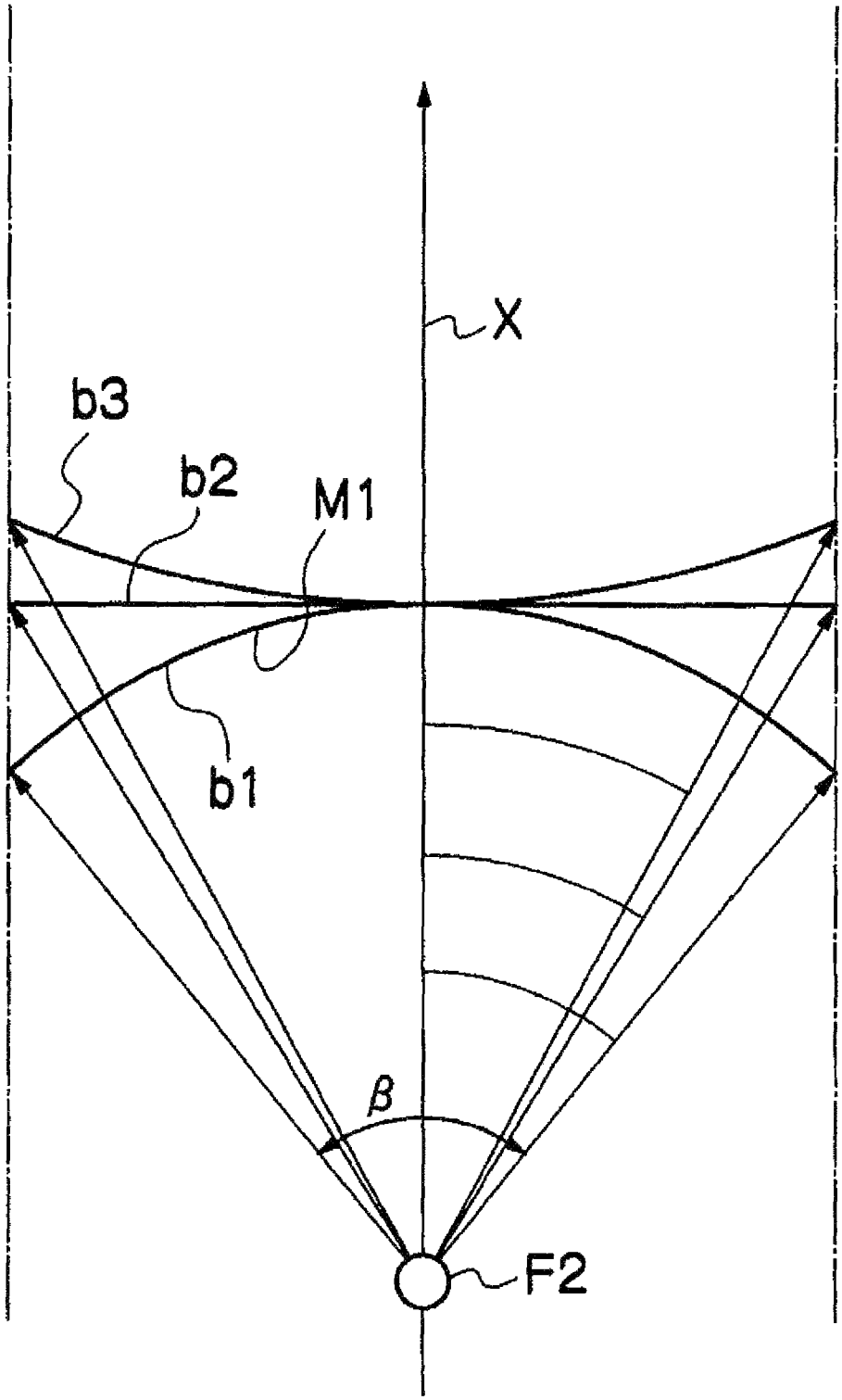
FIG. 5 illustrates an example of a sectional shape of a rear surface of the elliptical collimator lens which appears when being sectioned along a plane including an optical axis X and a minor axis b.

Since the shape of the rear surface M1 of the elliptical collimator lens 200 is the rotationally asymmetric saddle-shaped surface (represented as a concave curve b1 in FIG. 5) convex along the minor axis b as described above, the capturing angle of light radiated by the light source (not illustrated) increases in comparison with a case where the rear surface M1 is formed as a plane, and a convex surface or the like (represented as a straight line b2, and convex curve b3 in FIG. 5). In effect, efficiency in utilization of light by the light source is improved.

The shape of the rear surface M1 can be determined as described above, and the shape of the front surface M2 of the elliptical collimator lens 200 can then be determined by a prescribed calculation on the basis of the shape of the rear surface M1. Since the shape of the front surface M2 can be determined on the basis of the shape of the rear surface M1, it becomes the rotationally asymmetric convex surface in this example.

Next, the exemplary sector-shaped lens part 10 conceptually cut out from the elliptical collimator lens 200 having the above configuration will be described.

As illustrated in FIG. 3, the sector-shaped lens part 10 conceptually cut out from the elliptical collimator lens 200 can be a lens part (part A in FIG. 3) which corresponds to a central angle 2α (α=180/4=45 degrees) in the elliptical collimator lens 200 and is bilaterally symmetric with respect to the minor axis b of the elliptical collimator lens 200. That is, the lens part (part A in FIG. 3) can be located between a plane S1 (including the optical axis X and tilted by +α degrees with respect to the minor axis b) and a plane S2 (including the optical axis X and tilted by −α degrees with respect to the minor axis b) and is conceptually cut out.

Figure 6:
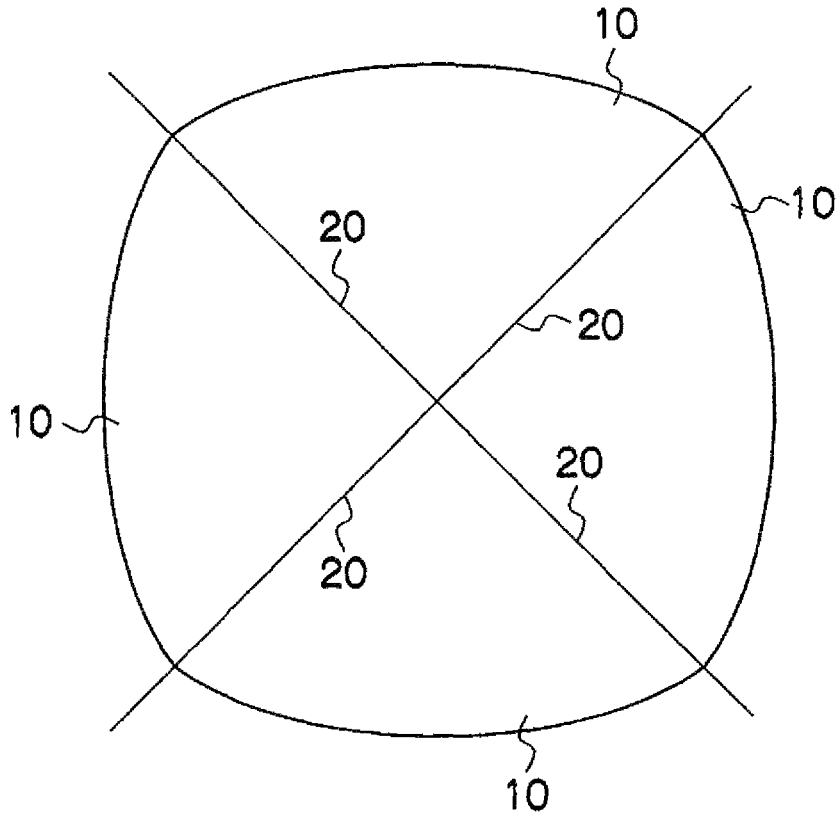
FIG. 6 is a plan view of the projection lens for lighting equipment illustrated in FIG. 1.
Figure 7:
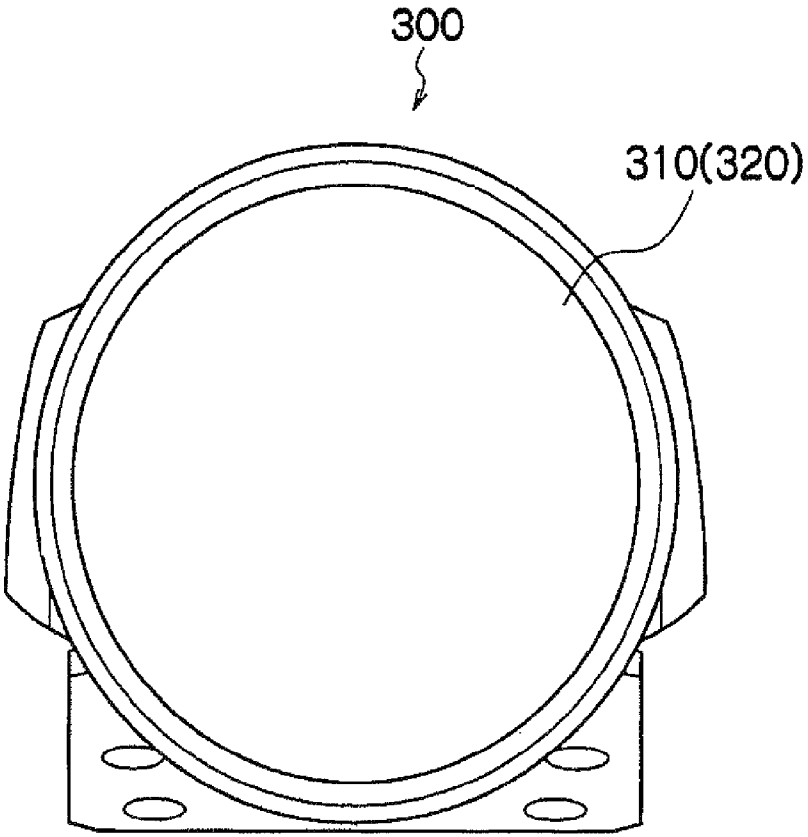
Fig. 7 (B) CONVENTIONAL ART
FIGS. 7 (A) and (B) are an exemplary side view and front view, respectively, of a conventional projection lens.
Figure 7:
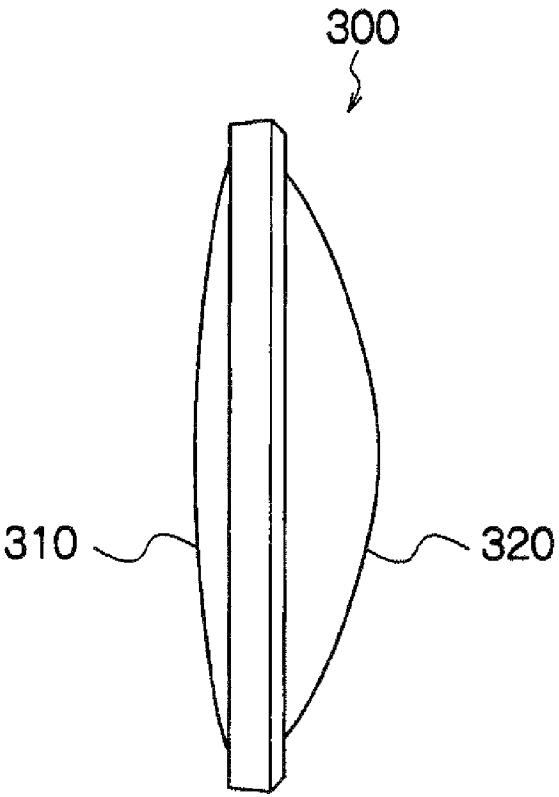
Fig. 7 (A) CONVENTIONAL ART

The projection lens 100 for lighting equipment, which has one focus F1 and functions as a collimator lens and is substantially quadrilateral in planar view, can be configured by circumferentially disposing four sector-shaped lens parts 10 as illustrated in FIG. 6. Since the sector-shaped lens part 10 in this example is bilaterally symmetric with respect to the minor axis b and the elliptical collimator lens 200 is rotationally asymmetric, a common edge 20 between a sector-shaped lens part 10 and an adjacent sector-shaped lens part 10 is formed without a step on the surface of the projection lens 100 as illustrated in FIGS. 1, 6 and the like. Since no step is formed at the common edge 20, the common edge (ridge) 20 may not affect characteristics in light distribution property of the projection lens 100.

Since each sector-shaped lens part 10 of the projection lens 100 can be a sector-shaped lens part that is bilaterally symmetric with respect to the minor axis b of the elliptical collimator lens 200, an increase in oblateness of the elliptical collimator lens 200 can allow for a configuration of the projection lens 100 which is more quadrilateral in planar view.

Since the sector-shaped lens part 10 can include the saddle shaped surface that is convex along the minor axis b in the shape of the rear surface M1 of the elliptical collimator lens 200 (see FIGS. 3 to 5), the capturing angle of light radiated by the light source (not illustrated) of the projection lens 100 may increase in comparison with a case where the shape of the rear surface M1 is formed as a plane or the like. In effect, the efficiency of the projection lens 100 can be improved in utilization of light radiated by the light source.

As described above, the projection lens 100 of this embodiment is formed such that four of the sector-shaped lens parts 10 (the part A in FIG. 3) each corresponding to a central angle 2α (α=180/4=45 degrees) in the elliptical collimator lens 200 and which are bilaterally symmetric with respect to the minor axis b are circumferentially disposed. Therefore, the projection lens 100 can have a novel design, which is substantially quadrilateral in planar view and can have common edges 20 (four edges) formed on the surface without impairment in function as a collimator lens.

Next, a modification will be described. Although the above described example where the projection lens 100 is configured by circumferentially disposing the four sector-shaped lens parts 10 has been described, the disclosed subject matter is not limited to this. For instance, the projection lens 100 can be configured by circumferentially disposing N (where N is an integer greater than or equal to three) of the sector-shaped lens parts 10. In this case, the sector-shaped lens part 10 conceptually cut out from the elliptical collimator lens 200 can be a sector-shaped lens part which has the central angle 2α (α=180/N, where N is an integer greater than or equal to three) in the elliptical collimator lens 200, and which can be bilaterally symmetric with respect to the minor axis b of the elliptical collimator lens 200.

Thus, a collimator lens with the novel design which has the shape of the N-sided polygon (e.g. quadrilateral) in planar view or the shape similar to the N-sided polygon, and has the common edges (N edges) formed on the surface, and operates without impairment in function as a collimator lens can be configured.

In the above embodiment, it has been described that the sector-shaped lens part 10 conceptually cut out from the elliptical collimator lens 200 is the lens part (the part A in FIG. 3) that is bilaterally symmetric with respect to the minor axis b in the elliptical collimator lens 200. However, the disclosed subject matter is not limited to this. For instance, if there is no problem in the efficiency in utilization of light, the sector-shaped lens part 10 conceptually cut out from the elliptical collimator lens 200 may be the lens part (part B in FIG. 3) bilaterally symmetric with respect to the major axis a in the elliptical collimator lens 200.

This can also configure the projection lens 100 with a novel design which has a shape of a N-sided polygon (e.g. quadrilateral) in planar view or the shape similar to the N-sided polygon and has the common edges (N edges) formed on the surface.

It has been described that the shape of the rear surface M1 of the elliptical collimator lens 200 is the rotationally asymmetric saddle-shaped surface (represented as the concave curve b1 in FIG. 5) convex along the minor axis b in the above-mentioned embodiment. However, the disclosed subject matter is not limited to this. For instance, if there is no problem in the efficiency in utilization of light, another shape can be adopted.

It has also described that the projection lens 100 is integrally formed, for instance, by injection-molding transparent or translucent material such as acryl, polycarbonate or the like in the above-mentioned embodiment. However, the disclosed subject matter is not limited to this. For instance, the projection lens 100 can be formed by polishing glass or the like.

Example 1

An example where the projection lens 100 of the above-described embodiment is used as a projection lens for a vehicular headlamp will be described.

Figure 8:
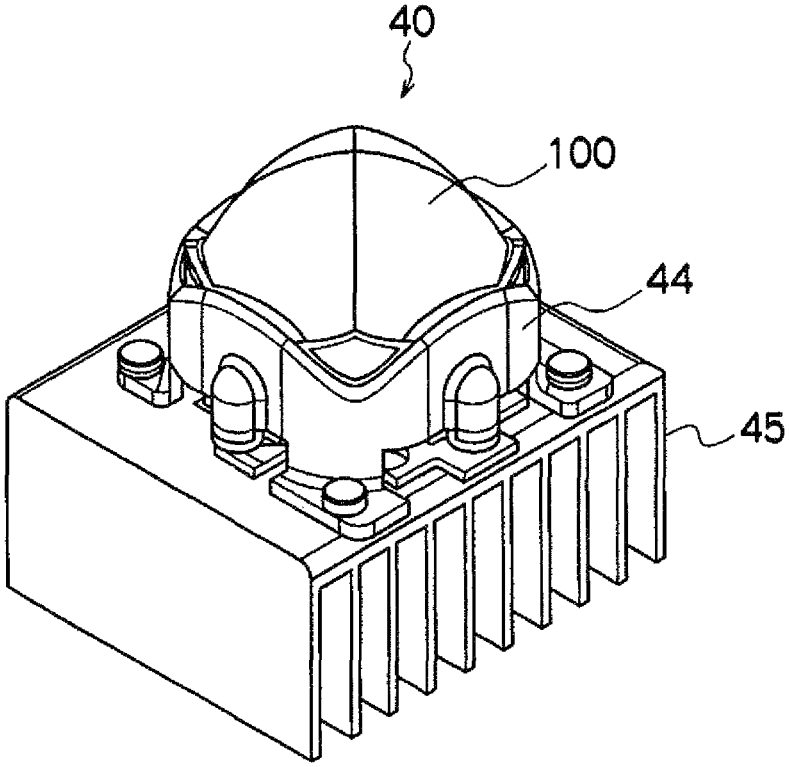
FIG. 8 is a perspective view of a direct projection type vehicular headlamp including the projection lens for lighting equipment of FIG. 1.
Figure 9:
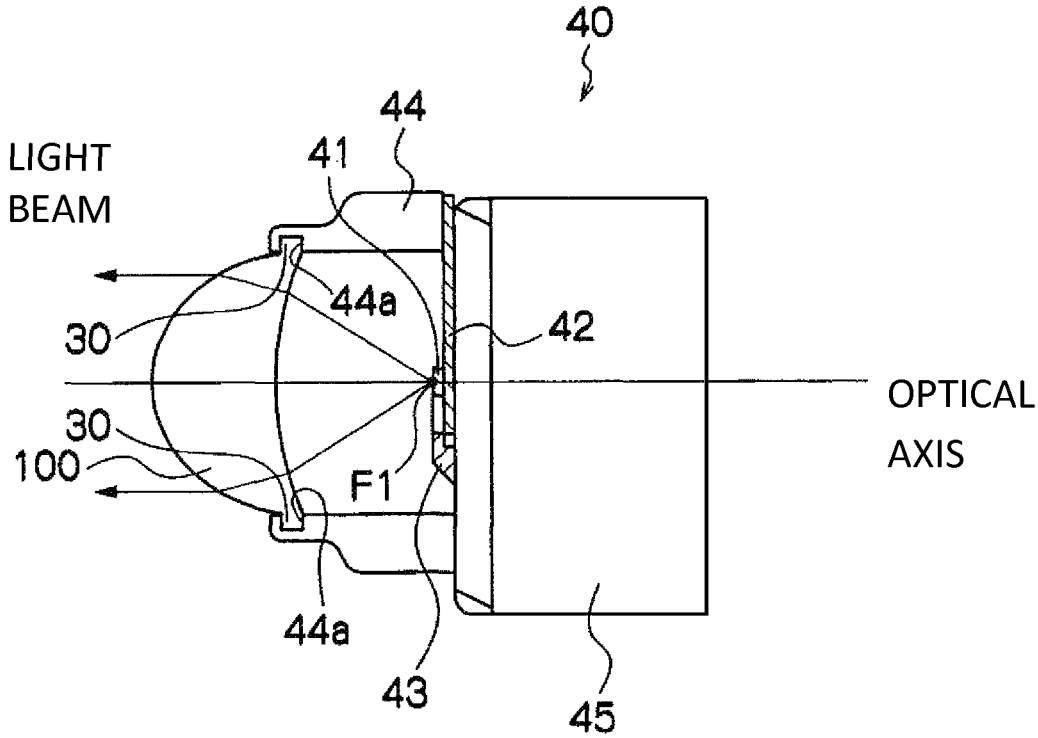
FIG. 9 is a sectional view of the vehicular headlamp illustrated in FIG. 8 as viewed from a direction perpendicular to the optical axis (not illustrated)

FIG. 8 is a perspective view of an exemplary direct projection type vehicular headlamp 40 that includes the projection lens 100 of FIG. 1. FIG. 9 is a sectional view of the vehicular headlamp 40 illustrated in FIG. 8 observed from a direction perpendicular to the optical axis (not illustrated).

In this example, the direct projection type lighting equipment means lighting equipment which has a light source disposed substantially at the focus F1 of the projection lens 100 and which directly projects an image of the light source in a radiating direction without intervention of a reflecting mirror.

The vehicular headlamp 40 can include an LED light source 41, a substrate 42, a shutter 43, a lens holder 44, a heat sink 45, and the projection lens 100.

The vehicular headlamp 40 can be configured such that the LED light source 41 is disposed substantially at the focus F1 of the projection lens 100 as described above.

The LED light source 41 can be mounted on the substrate 42, which is constituted by aluminum or ceramic or the like, such that the light emitting surface thereof is oriented in a direction (radiating direction) toward the projection lens 100.

The shutter 43 can be provided on a side of the light emitting surface of the LED light source 41. The shutter 43 shields a part of an image of the light source 41 projected through the projection lens 100, and a desired light distribution pattern is formed. It should be noted that the shutter 43 is not necessarily provided, if not desired.

The lens holder 44 can be mounted on the light source 41 side of the substrate 42 and the like. A concave portion 44*a* into which the flange portion 30 of the projection lens 100 is fixedly inserted can be formed in the lens holder 44. The projection lens 100 can be held by the lens holder 44 by means of insertion and fixation of the flange portion 30 into the concave 44*a*. The lens holder 44 retains optical positioning between the LED light source 41 and the projection lens 100.

The heat sink 45 can be provided on the rear surface (opposite side of the radiating direction) of the substrate 42 to dissipate heat of the LED light source 41.

With the above configuration, the vehicular headlamp 40 projects the image of the light source 41 disposed substantially at the focus F1 in the radiating direction using the projection lens 100. This allows the vehicular headlamp 40 to appropriately radiate light from the light source 41 in the desired distribution pattern.

Example 2

Although the above-mentioned vehicular headlamp 40 has been described as an example of a direct projection type lighting equipment using the projection lens 100, the projection lens 100 can also be used as a following vehicular headlamp 50 as will be described below.

Figure 10:
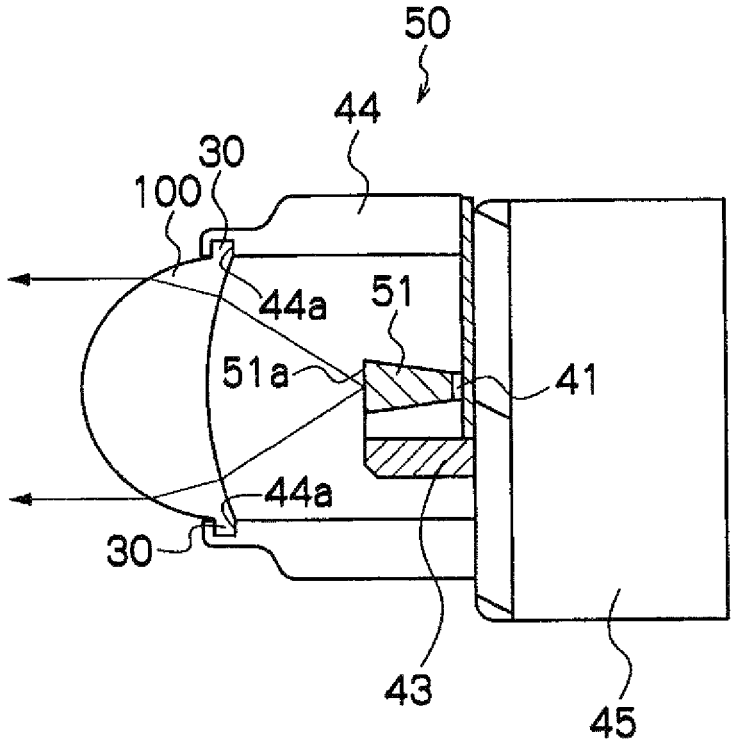
FIG. 10 is a sectional view of another embodiment of a direct projection type vehicular headlamp including the projection lens for lighting equipment of FIG. 1.

FIG. 10 is a sectional view of another direct projection type vehicular headlamp 50 including the projection lens 100.

The vehicular headlamp 50 is different from the above-mentioned vehicular headlamp 40 in that a light guide 51 is provided forward of the light emitting surface of the LED light source 41 with respect to the radiating direction. Accordingly, only the difference will be described in this example. Because the remaining configuration is analogous to that of the above-mentioned vehicular headlamp 40, identical reference numbers are assigned thereto and detailed description is omitted.

The light guide 51 can be made of a material having a property which allows light to pass therethrough such as acryl, and which allows the light from the LED light source 41 to reach the light emitting surface 51*a*.

The projection lens 100 can have a focus F1 located substantially at the light emitting surface 51*a* of the light guide 51, and can project light from the LED light source 41 in the radiating direction.

With the above configuration, the vehicular headlamp 50 projects the image of the light source 41 disposed substantially at the focus F1 in the radiating direction using the projection lens 100. This allows the vehicular headlamp 50 to appropriately radiate light from the light source 41 in the desired distribution pattern.

Example 3

Although examples where the projection lens 100 is used in direct projection type lighting equipment has been described in examples 1 and 2 above, the collimator lens 100 can also be used for a projector type vehicular headlamp 60 having a reflecting mirror.

Figure 11:
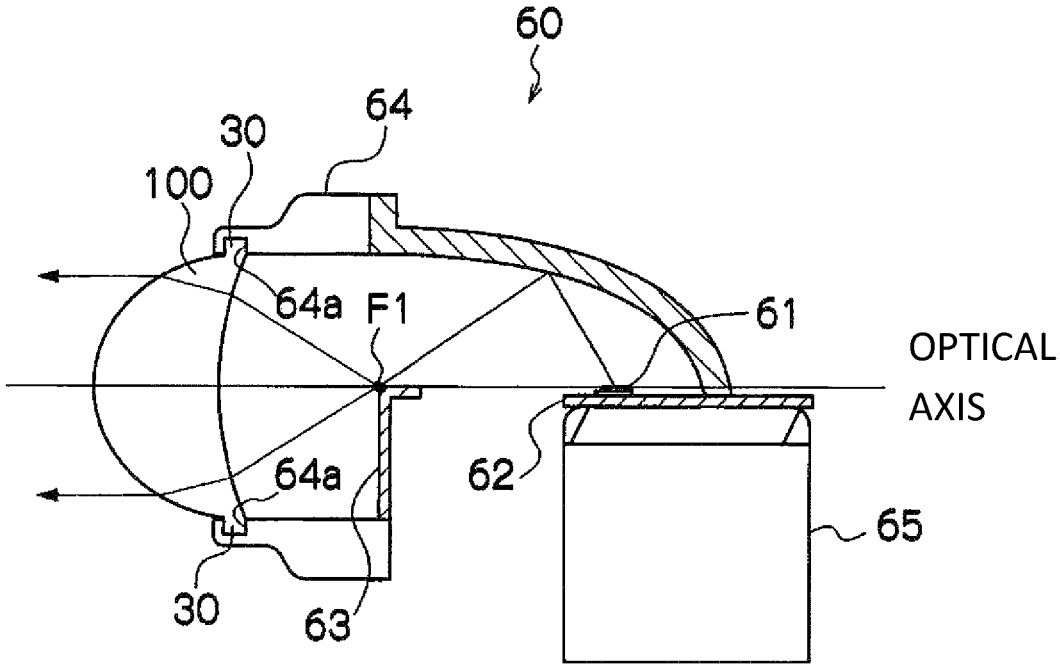
FIG. 11 is a sectional view of a projector type vehicular headlamp including the projection lens for lighting equipment of FIG. 1.

FIG. 11 is a sectional view of a projector type vehicular headlamp 60 including the projection lens 100.

In this example, the projector type lighting equipment means lighting equipment where a light source is disposed substantially at a first focus and an image of the light source is projected in the radiating direction via the reflecting surface and the projection lens.

The vehicular headlamp 60 can include a LED light source 61, a substrate 62, a shutter 63, a lens holder 64, a heat sink 65, a reflector 67, and the projection lens 100.

The vehicular headlamp 60 can be configured such that the LED light source 31 is disposed substantially at a first focus of the reflector 67 as described above.

The LED light source 61 can be mounted on the substrate 62 such that the light emitting surface is aligned in a direction parallel to or at a prescribed angle with the optical axis of the vehicular headlamp 60. Light can be radiated in a direction perpendicular to or at a prescribed angle with the optical axis of the vehicular headlamp 60.

The reflector 67 can be configured as an elliptical reflecting surface whose first focus is, for instance, substantially at the light emitting surface of the LED light source 61. The reflector 67 can be configured to reflect light from the LED light source 61 to a second focus located substantially at the focus of the projection lens 100.

The shutter 63 can be located substantially at the focus F1 of the projection lens 100. The shutter 63 shields a part of a light beam from the LED light source 61 projected through the projection lens 100 for lighting equipment and forms a desired light distribution pattern. It should be noted that the shutter 63 is not necessarily provided, if not desired.

The lens holder 64 can be mounted, for instance, on the reflector 67. A concave 64*a* into which the flange portion 30 of the projection lens 100 for lighting equipment is fixedly inserted can be formed in the lens holder 64. The projection lens 100 can be held by the lens holder 64 by means of insertion and fixation of the flange portion 30 into the concave 64*a*. The lens holder 64 retains optical positioning between the reflector 67 and the projection lens 100.

With the above-described configuration, the vehicular headlamp 60 projects the image of the light source 61 substantially at the focus F1 in the radiating direction using the projection lens 100. This allows the vehicular headlamp 60 to radiate the light from the light source 61 with a desired light distribution pattern appropriately.

The above-mentioned embodiment has been described only by way of example in all respects. The disclosed subject matter should not be limitingly construed by this description. The disclosed subject matter can be implemented in other various forms without departing from the spirit and scope of the present invention.

The invention claimed is:

1. A projection lens for lighting equipment, comprising:

N number of lens parts, each of the lens parts corresponding to a central angle $2\alpha$ degrees (where $\alpha=180/N$, and N is an integer greater than or equal to 3) and being bilaterally symmetric in a rotationally asymmetric elliptical collimator lens, wherein the projection lens is integrally formed in a shape where N of the lens parts are circumferentially disposed so that vertexes of the lens parts are located at a same position in plan view, and wherein the projection lens has, on its outer surface, the N number of edges located between the lens parts adjacent to each other, and wherein a shape of a rear surface of the collimator lens is formed such that a sectional shape of the rear surface which appears in section along a first plane including the optical axis and a minor axis of the collimator lens and a second plane parallel to the first plane is a concave curve concave to a focus point of the collimator lens, and a sectional shape of the rear surface which appears in section along a primary plane including the optical axis and a major axis of the collimator lens and a secondary plane parallel to the primary plane is a convex curve convex to the focus point of the collimator lens.

2. The projection lens for lighting equipment according to claim 1, wherein the bilaterally symmetric lens part is a lens part bilaterally symmetric with respect to the minor axis of the collimator lens.

3. The projection lens for lighting equipment according to claim 1 wherein the concave curve and the convex curve are selected from the group consisting of a quadric curve, a hyperbola and a spline curve.

* * * * *